US006692072B2

(12) United States Patent
Nelson et al.

(10) Patent No.: US 6,692,072 B2
(45) Date of Patent: Feb. 17, 2004

(54) BOOSTER SEAT

(75) Inventors: Elizabeth Nelson, Walpole, MA (US); Gerry J. Kaeblein, North Attleboro, MA (US); Vincent J. DeSanto, Lincoln, RI (US); John P. Kearney, North Attleboro, MA (US); Dana L. Padula, Cumberland, RI (US); Kyle A. Nanna, Westwood, MA (US); Susan M. Grassel, Lincoln, RI (US); James J. Britto, Westport, MA (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 09/852,549

(22) Filed: May 10, 2001

(65) Prior Publication Data

US 2002/0167214 A1 Nov. 14, 2002

(51) Int. Cl.[7] ..... A47C 1/02

(52) U.S. Cl. ..... 297/250.1; 297/485; 297/467; 297/129

(58) Field of Search ..... 297/485, 467, 297/250.1, 129

(56) References Cited

U.S. PATENT DOCUMENTS

| | | | | |
|---|---|---|---|---|
| 3,366,294 A | * | 1/1968 | Stephenson | 224/275 |
| 4,521,052 A | | 6/1985 | Cone | |
| 4,527,830 A | * | 7/1985 | Meyers | 297/188.09 |
| 4,597,605 A | * | 7/1986 | Gilbert | 297/228.1 |
| 4,687,452 A | * | 8/1987 | Hull | 441/131 |
| 4,715,652 A | | 12/1987 | Ward | |
| 4,781,413 A | | 11/1988 | Shumack, Jr. | |
| 4,836,605 A | | 6/1989 | Greenwood et al. | |

(List continued on next page.)

FOREIGN PATENT DOCUMENTS

| | | |
|---|---|---|
| DK | 28 45 983 A1 | 10/1978 |
| EP | 0 853 019 A1 | 7/1998 |
| GB | 1381304 | 1/1975 |
| GB | 2 262 511 A | 6/1993 |
| GB | 2 346 551 A | 8/2000 |
| WO | WO 94/12079 | 6/1994 |
| WO | WO 96/04824 A1 | 2/1996 |
| WO | WO 97/23153 | 7/1997 |

*Primary Examiner*—Peter M. Cuomo
*Assistant Examiner*—Joseph Edell
(74) *Attorney, Agent, or Firm*—Fish & Richardson P.C.

(57) ABSTRACT

A booster seat comprises a base having a lower surface sized to rest upon a chair seat and an upper surface generally parallel to the lower surface, a seat back hinged connected to the base at a rearward portion of the booster seat and constructed to be folded toward and secured against the base for storage, an adjustable strap extending from the booster seat a length sufficient to secure the booster seat upon a chair, wherein the upper surface and the lower surface are spaced apart by at least about 1 inch when supporting a child weighing about 20 pounds thereupon to provide an elevated seating position, and wherein, with the seat back folded against the upper surface of the base for storage, the booster seat has an overall thickness, measured perpendicularly to the lower surface of the base, of less than about 3 inches.

28 Claims, 5 Drawing Sheets

U.S. PATENT DOCUMENTS 4,842,329 A 6/1989 Owens
4,871,210 A * 10/1989 Alexander et al. ..... 297/485
4,925,241 A * 5/1990 Geraci ..... 297/229
5,056,533 A 10/1991 Solano
5,158,337 A * 10/1992 Leggett ..... 297/250.1
D343,088 S 1/1994 Owens
5,332,286 A 7/1994 Atherton et al.
5,332,292 A 7/1994 Price et al.
5,333,336 A 8/1994 Langsam
5,335,968 A 8/1994 Sheridan et al.
5,354,121 A * 10/1994 Allum ..... 297/485
5,469,592 A * 11/1995 Johnson ..... 5/654
5,499,860 A 3/1996 Smith et al.
5,507,558 A 4/1996 Kain
5,516,188 A * 5/1996 Bruhnke et al. ..... 297/129
5,516,193 A 5/1996 Simpson
5,560,679 A 10/1996 Barnholdt
5,580,125 A 12/1996 Alger
5,580,132 A 12/1996 Rediske
5,588,699 A 12/1996 Rundle et al.
5,609,389 A 3/1997 Longoria et al.
5,641,199 A * 6/1997 Bond-Madsen ..... 297/229
5,685,604 A 11/1997 Kain
5,705,252 A 1/1998 Lea et al.
5,921,626 A 7/1999 Baker
5,944,379 A 8/1999 Yates
5,979,975 A 11/1999 Hiraoka
6,390,345 B1 * 5/2002 Brown et al. ..... 224/578

* cited by examiner

BOOSTER SEAT

TECHNICAL FIELD

This invention relates to booster seats.

BACKGROUND

Typically, a small child is not able to sit at an adult-sized table in an adult sized chair because a child seated in the chair is positioned too low to use the table comfortably. A booster seat, placed on the seat of the adult-sized chair, provides additional seating height for the small child and positions the child to use the adult-sized table.

SUMMARY

This invention features a booster seat including a base having a lower surface sized to rest upon a chair seat and an upper surface generally parallel to the lower surface. A seat back is hingedly connected to the base at a rearward portion of the booster seat and constructed to be folded toward and secured against the base for storage. An adjustable strap extends from the booster seat a length sufficient to secure the booster seat upon a chair.

In one aspect, the invention features a booster seat including a base having an upper surface and the lower surface are spaced apart by at least about 1 inch when supporting a child weighing about 20 pounds thereupon to provide an elevated seating position. However, with the seat back folded against the upper surface of the base for storage, the booster seat has an overall thickness, measured perpendicularly to the lower surface of the base, of less than about 3.5 inches (preferably less than about 3 inches and more preferably less than about 2.5 inches).

In another aspect, the invention features a booster seat having a base that is expandable in thickness between a collapsed condition and an expanded condition to provide a range of seating elevations. The booster seat has a total weight of less than about 2.5 pounds.

Various embodiments of either aspect include one or more additional features.

The booster seat has an adjustable safety belt connected to the seat back and to the base. In some examples, the safety belt has a length sufficient to wrap around the front of a small child seated in-between the safety strap and the seat back, thereby preventing the small child from exiting the seat.

The adjustable strap includes a first adjustable strap extending from the seat back of the booster seat a sufficient length to secure the booster seat to a chair back and a second adjustable strap extending from the base of the booster seat a sufficient length to secure the booster seat to a chair base. The first and second adjustable straps have quick release buckles.

The base is expandable in thickness between a collapsed condition and an expanded condition and defines an inflatable bladder volume. The base includes a sealable valve for hydraulic communication between the bladder volume and atmosphere. A spring member is contained within the bladder volume to bias the base toward its expanded condition. The spring member is adapted to provide sufficient expansion force, with the base in its collapsed condition, to expand the base upon opening of the valve. The spring member is a resilient foam.

The upper surface comprises a soft washable nylon material.

A zipper is disposed on a perimeter of the upper surface and a perimeter of the lower surface such that when the zipper is closed it retains the base in its collapsed condition.

A side web is connected to an edge of the seat back and to an edge of the base for limiting the rotation of the seat back about its hinged connection to the base. In some examples, the side web includes a first side web disposed on a first side of the booster seat and a second side web disposed on a second side of the booster seat.

The seat back has a touch fastener strip for securing the seat back to the lower surface of the base.

Embodiments may have one or more of the following advantages. In one aspect, the invention features a readily transportable folding booster seat that provides a significant amount of boost (i.e., more than one inch for a child of about 20 pounds), yet of a limited thickness, as folded, that enables storage of the seat within a three-inch wide space, such as in a diaper bag, or under a car seat, for example. By employing a self-inflating foam, for example. By employing a self-inflating foam, for example, some embodiments can actually provide greater boost than their overall folded thickness.

In another aspect, this invention features an adjustable-height booster seat that has a total weight of less than about 2 pounds so as to be easily carried by a toddler. As configured, the booster seat can also provide the advantage of being foldable into a soft, suitcase-like package with a handle for carrying.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
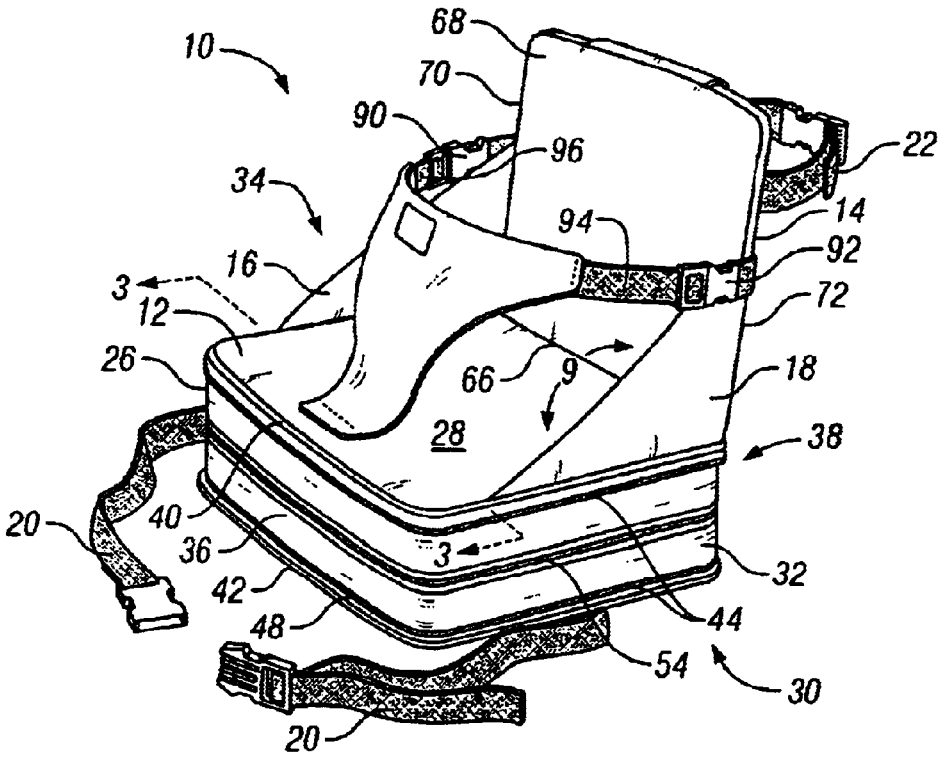
FIG. 1 is a perspective view of a booster seat.
Figure 2:
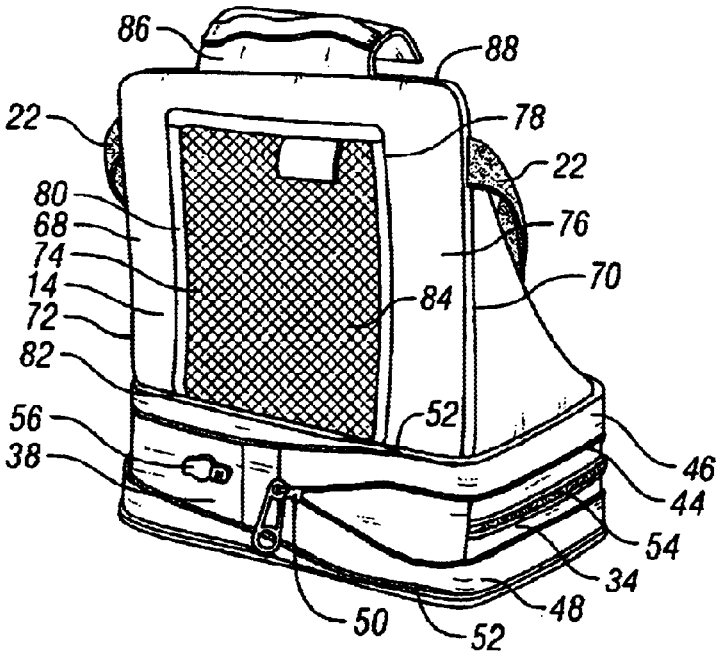
FIG. 2 is a second perspective view of the booster seat.

Referring to FIGS. 1 and 2, one example of a booster seat 10 includes a seat base 12 and a seat back 14 attached to seat base 12. Side panels 16, 18 are disposed on the sides of seat 10 and each are attached to seat base 12 and to seat back 14. Base strap 20 is attached to seat base 12 and secures booster seat 10 to a chair seat as described below. Back strap 22 is attached to seat back 14 and secures booster seat 10 to a chair back as described below. Booster seat 10 also includes a safety belt 24 attached to both seat base 12 and seat back 14 for preventing a small child sitting in booster seat 10 from moving or falling from seat 10. Preferably, booster seat 10 has a weight of less than about 2.5 pounds. More preferably, booster seat 10 has a weight of less than about 2 pounds.

Seat base 12 is configured in the shape of a rectangular block having a top portion 28, bottom portion 30, side portions 32, 34, a front portion 36, and a rear portion 38 and has a length of about 11.5 inches and a width of about 9.25 inches. Seat base 12 has a maximum nominal thickness of about 4 inches, which sets an upper limit for the seating height provided by booster seat 10. While in use, seat base 12 may be compressed, as described in more detail below, to a nominal thickness of at least about one inch. Top portion 28, bottom portion 30, side portions 32, 34, front portion 36, and rear portion 38 all comprise a soft, washable material that resists tearing and scuffing. In one example, the material is a 420 dernier woven nylon fabric with a polyvinyl chloride (PVC) backing.

Top portion 28 has a perimeter 40 and bottom portion 30 has a perimeter 42. Disposed on perimeters 40, 42 is outer zipper 44 having a first zipper panel 46 disposed on perimeter 40 and a second zipper panel 48 disposed on perimeter 42. Outer zipper 44 has a first end 50 and a second end 52. First end 50 is disposed on rear panel 38 and outer zipper 44 follows perimeters 40, 42 around seat base 12 and past first end 50 so that second end 52 of outer zipper 44 overlaps first end 50 by about 4 inches. Closing outer zipper 50 maintains seat base 12 in a collapsed configuration as described in more detail below.

Seat base 12 also includes inner zipper 54 disposed on and bisecting side portion 32, front portion 36 and side portion 34. Inner zipper 54 provides access to the interior of seat base 12 as described in more detail below.

Valve 56 is disposed on rear portion 38 of seat base 12 and may be configured in either an open or a closed position. When in a closed position, as shown in FIG. 2, valve 56 prevents communication of air between the exterior and interior of seat base 12. When in an open position, valve 56 permits communication of air between the interior and exterior of seat base 12 as described in more detail below.

Figure 3:
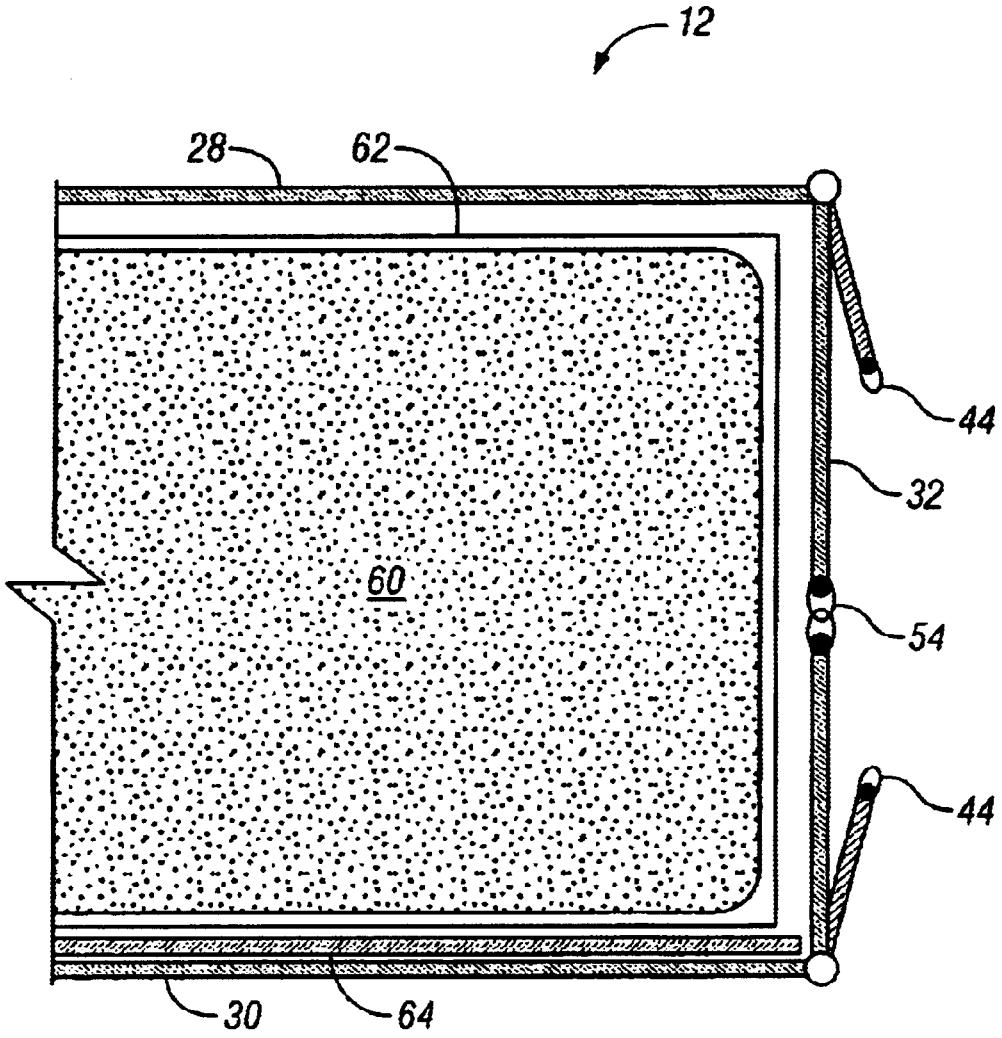
FIG. 3 is a partial cross section of the booster seat base.

Referring to FIG. 3, seat base 12 includes member 60, which provides support and cushioning for an occupant of booster seat 10. In one example, member 60 is a polyurethane foam available from New Prokin International, Ltd., China, and has a length of about 11 inches, a depth of about 9 inches, and a thickness of about 2.25 inches. Member 60 may be a resilient foam such as is commonly employed in self-inflating camping mattress pads, for example. Member 60 is enclosed by bladder 62 made from PVC having a thickness of about 0.100 inches. Bladder 62 is connected to valve 56 (FIG. 2) but otherwise forms an airtight barrier enclosing member 60. By expelling air from or drawing air into bladder 62, the thickness of seat base 12 and seating height added to a chair by booster seat 10 may be reduced or increased, respectively.

Seat base 12 also includes panel 64 disposed within seat base 12 and below member 60. Panel 64 is relatively rigid in comparison to member 60 and has a length of about 11 inches, a width of about 9 inches, and a thickness of about 0.13 inches. In one example, panel 64 is formed from polyethylene board having a thickness of about 0.08 inches Referring again to FIGS. 1 and 2, seat back 14 is disposed on the rear edge 66 of top portion 28 and is hinged to seat base 12 so that seat back 14 may fold onto seat base 12 for storage, as described below. Accordingly, seat back 14 has a length of about 11.5 inches and a width of about 9.25 inches. Seat back 14 has a soft, washable exterior 68 that resists tearing and scuffing. In one example, exterior 68 includes a 420D woven nylon fabric with a PVC backing. The seat back 14 also includes a rigid panel (not shown) disposed on the interior of seat back 14. The rigid panel (not shown) could be a polyethylene board having a thickness of about 0.08 inches, for example. Side panels 16, 18, attached to side portions 70, 72 of seat back 14, respectively, retain seat back 14 in an open position at an angle "a". In one example, angle "a" is about 100 degrees. Mesh 74 is disposed on rear portion 76 of seat back 14 and attached at edges 78, 80, and 82 to form pocket 84. In one example, pocket 84 is about 6.5 inches long and 8 inches deep.

Flap 86 is disposed on front edge 88 of seat back 14. When seat back 14 is folded on top of seat base 12, flap 86 secures seat back 14 to seat base 12 by wrapping around front portion 36 of seat base 12 and fastening to bottom portion 30 using a touch fastener strip (not shown).

Safety belt 24 is attached to top portion 28 of seat base 12 and to side portions 70, 72. Safety belt 24 includes quick release buckles 90, 92 to facilitate placing a child in and removing them from booster seat 10. Buckles 90, 92 are also configured to permit adjustment of straps 94, 96 to accommodate children of different sizes. Preferrably, safety belt 24 has a length of about 26 inches.

Figure 4:
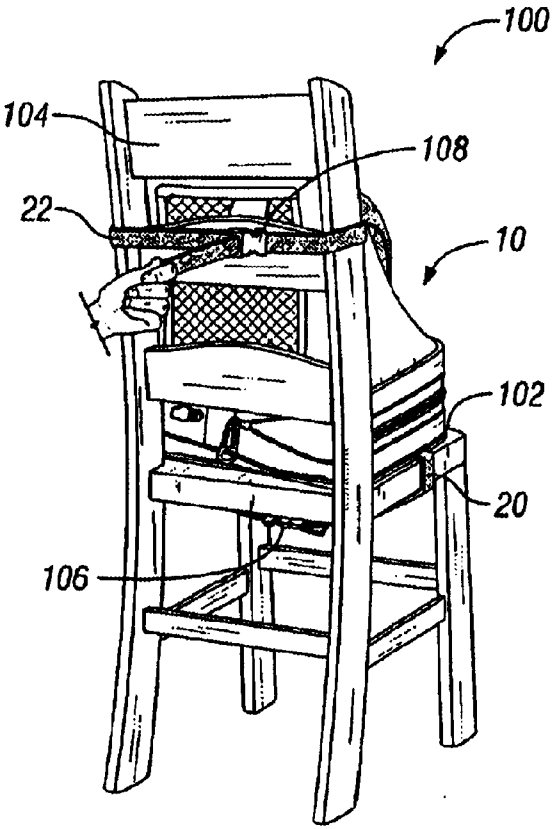
FIG. 4 is a perspective view of the booster seat disposed on a chair.

Referring to FIG. 4, booster seat 10 is secured to chair 100 with straps 20, 22. Specifically, strap 20 is a continuous strap that extends through the base and has a total length of about 54 inches. Preferably, the strap extends from side portions 32 and from side portion 34 for a combined exposed length of at least about 18 inches (more preferably, at least about 24 inches) to extend under the seat of a typical dining chair, such as chair 100. Strap 20 is wrapped around chair base 102 and fastened by locking quick release buckle 106, which is configured to permit tightening of strap 20 around chair base 106.

Strap 22 extends from side portions 70, 72 (FIG. 1) for a preferred combined length of at least about 12 inches (more preferably, at least about 18 inches) and is positioned around chair back 104. Booster seat 10 is secured to chair 100 by fastening quick release buckle 108 and tightening strap 22.

Figure 5:
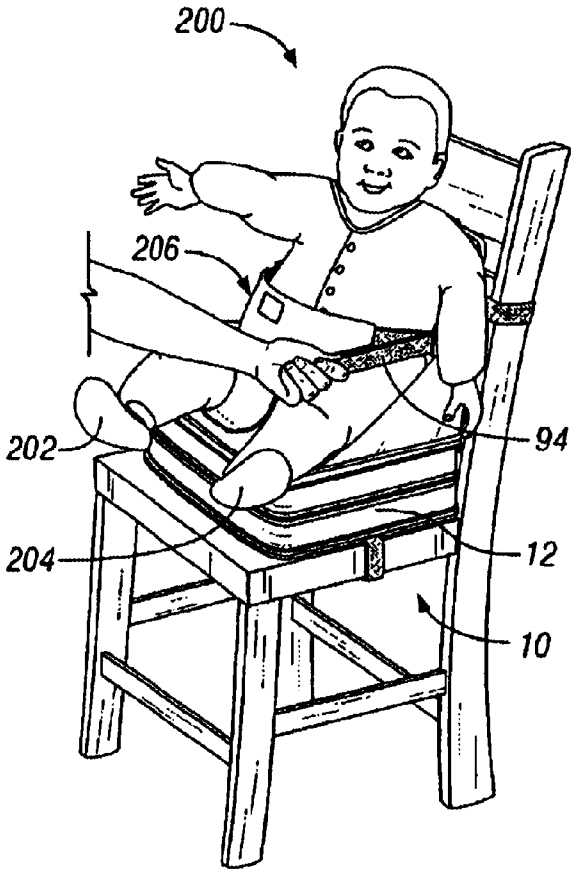
FIG. 5 is an illustration of a child sitting on the booster seat.

Referring to FIG. 5., child 200 is seated in booster seat 10 with safety strap 24 between legs 202, 204 and around the abdomen 206. Adjusting straps 92 (not shown) and 94 secures child 200 to booster seat 10 and raises the seating height of child 200 by at least the thickness of seat base 12. In one example, child 200 weighs about 20 pounds and seat base 12 has a nominal thickness of at least about 1 inch while child 200 is seated thereupon.

Figure 6:
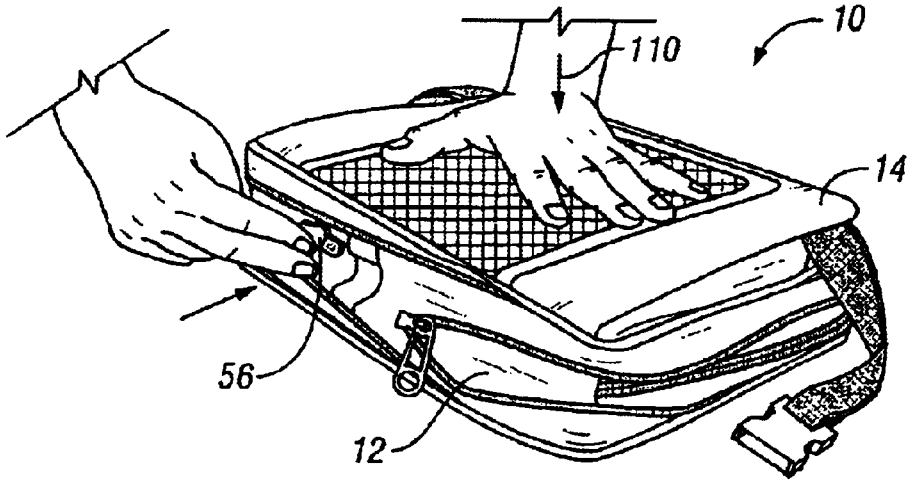
FIG. 6 is a perspective view of the booster seat being collapsed.
Figure 7:
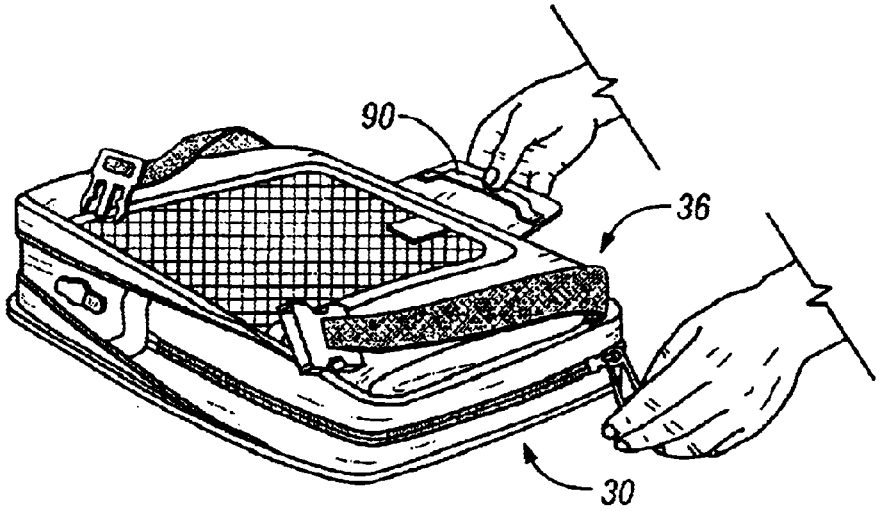
FIG. 7 is a perspective view of the booster seat being stored.

Referring to FIGS. 6 and 7, booster seat 10 is stored by opening valve 56 and folding seat back 14 on top of seat base 12. Compressing seat base 12 in direction 110 forces air from bladder 62 (not shown) through valve 56 and compresses member 60 (not shown). While seat base 12 is compressed, valve 56 is closed to form an airtight seal and prevent seat base 12 from expanding to its original position. Outer zipper 44 is then zipped closed around seat base 12 to prevent seat base 12 from returning to its expanded condition should air accidentally enter bladder 62. Flap 86 is then wrapped over front portion 36 and fastened to bottom portion 30 of seat base 12 and permits carrying of booster seat 10 with handle 90. In one example, flap 86 is fastened with a hook-and-loop touch fastener strip. The nominal thickness of booster seat 10 in this configuration is preferably less than about 3.5 inches and is at least about one inch. In this particular embodiment, the nominal thickness is about 3 inches. In another embodiment, the nominal thickness is about 2.5 inches.

Seat base 10 is inflated by opening valve 56. Member 60, compressed during storage of booster seat 10, described above, pushes apart top portion 28 and bottom portion 30 of seat base 12, thereby drawing air into bladder 62 through valve 54. After air enters bladder 62, valve 54 is closed to prevent air from exiting bladder 62 when a child is placed in booster seat 10. In this manner, booster seat 10 is "self inflating" because air is drawn in automatically by the expansion of member 60.

Figure 8:
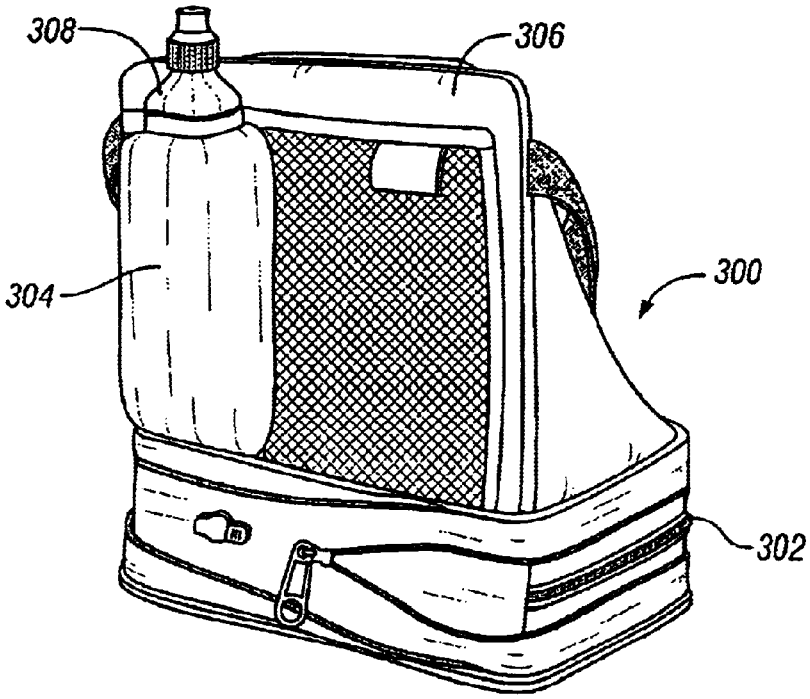
FIG. 8 is a perspective view of a second booster seat.

Referring to FIG. 8, seat 300 includes pocket 304 disposed on seat back 306 and configured to carry bottle 308. In one example, bottle 308 is a 16 oz. squeeze-type water bottle.

Figure 9:
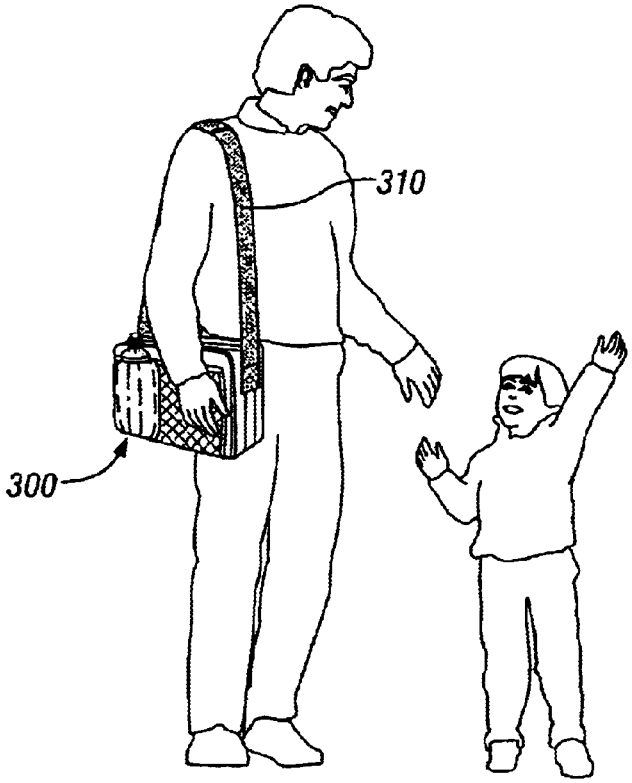
FIG. 9 is an illustration of the second booster seat being carried.

Referring to FIG. 9, seat 300 also includes an adjustable shoulder strap 310 for carrying seat 300.

A number of embodiments of the invention have been described. Nevertheless, it will be understood that various modifications may be made without departing from the spirit and scope of the invention. Accordingly, other embodiments are within the scope of the following claims.

What is claimed is:

1. A booster seat comprising:

a base expandable in thickness between a collapsed condition and an expanded condition and comprising:
a rigid lower panel sized to rest upon a chair seat,
a rigid upper panel generally parallel to the lower panel,
an inflatable bladder having a valve for selectively expanding the bladder but otherwise forming an airtight barrier enclosing a spring member contained within the bladder to bias the base toward an expanded condition;

a seat back hingedly connected to the base at a rearward portion of the booster seat and constructed to be folded toward and secured against the base for storage;

an adjustable strap extending from the booster seat a length sufficient to secure the booster seat upon a chair;

wherein the upper surface and the lower surface are spaced apart by at least about 1 inch when supporting a child weighing about 20 pounds thereupon to provide an elevated seating position; and wherein, with the seat back folded against the upper surface of the base for storage, the booster seat has an overall thickness, measured perpendicularly to the lower surface of the base, of less than about 3.5 inches.

2. The booster seat of claim 1 wherein the booster seat has an overall thickness of less than about 3 inches.

3. The booster seat of claim 1 wherein the booster seat has an overall thickness of less than about 2.5 inches.

4. The booster seat of claim 1 further comprising an adjustable safety belt connected to the seat back and to the base, said safety belt having a length sufficient to wrap around the front of a small child seated between the safety strap and the seat back, thereby preventing the small child from exiting the seat.

5. The booster seat of claim 1, wherein the adjustable strap comprises an adjustable strap extending from the seat back of the booster seat a sufficient length to secure the booster seat to a chair back.

6. The booster seat of claim 5, wherein the adjustable strap further comprises a quick release buckle.

7. The booster seat of claim 1, wherein the adjustable strap comprises an adjustable strap extending from the base of the booster seat a sufficient length to secure the booster seat to a chair base.

8. The booster seat of claim 7, wherein the adjustable strap further comprises a quick release buckle.

9. The booster seat of claim 1 wherein the spring member is adapted to provide sufficient expansion force, with the base in a collapsed condition, to expand the base upon opening of the valve.

10. The booster seat of claim 1 wherein the spring member comprises a resilient foam.

11. The booster seat of claim 1 wherein the upper surface comprises a soft washable nylon material.

12. The booster seat of claim 1 further comprising a zipper disposed on a perimeter of the upper surface and a perimeter of the lower surface such that when the zipper is closed the zipper retains the base in a collapsed condition.

13. The booster seat of claim 1 comprising a side web connected to an edge of the seat back and to an edge of the base for limiting the rotation of the seat back about the hinged connection to the base.

14. The booster seat of claim 13 wherein the side web comprises a first side web disposed on a first side of the booster seat and a second side web disposed on a second side of the booster seat.

15. The booster seat of claim 1 wherein the seat back further comprises a touch fastener strip for securing the seat back to the lower surface of the base.

16. A booster seat comprising:

a base expandable in thickness between a collapsed condition and an expanded condition and comprising:

a rigid lower panel sized to rest upon a chair seat, a rigid upper panel generally parallel to the lower panel, an inflatable bladder having a valve for selectively expanding the bladder but otherwise forming an airtight barrier enclosing a spring member contained within the bladder to bias the base toward an expanded condition;

a seat back hingedly connected to the base at a rearward portion of the booster seat and constructed to be folded toward and secured against the base for storage;

an adjustable strap extending from the booster seat a length sufficient to secure the booster seat upon a chair; and wherein the upper surface and the lower surface are spaced apart by at least about 1 inch when supporting a child weighing about 20 pounds thereupon to provide an elevated seating position.

17. The booster seat of claim 16 further comprising an adjustable safety belt connected to the seat back and to the base, said safety belt having a length sufficient to wrap around the front of a small child seated between the safety strap and the seat back, thereby preventing the small child from exiting the seat.

18. The booster seat of claim 16, wherein the adjustable strap comprises an adjustable strap extending from the seat back of the booster seat a sufficient length to secure the booster seat to a chair back.

19. The booster seat of claim 18, wherein the adjustable strap further comprises a quick release buckle.

20. The booster seat of claim 16, wherein the adjustable strap comprises an adjustable strap extending from the base of the booster seat a sufficient length to secure the booster seat to a chair base.

21. The booster seat of claim 20, wherein the adjustable strap further comprises a quick release buckle.

22. The booster seat of claim 16 wherein the spring member is adapted to provide sufficient expansion force, with the base in a collapsed condition, to expand the base upon opening of the valve.

23. The booster seat of claim 16 wherein the spring member comprises a resilient foam.

24. The booster seat of claim 16 wherein the upper surface comprises a soft washable nylon material.

25. The booster seat of claim 16 further comprising a zipper disposed on a perimeter of the upper surface and a perimeter of the lower surface such that when the zipper is closed the zipper retains the base in a collapsed condition.

26. The booster seat of claim 16 further comprising a side web connected to an edge of the seat back and to an edge of the base for limiting the rotation of the seat back about the hinged connection to the base.

27. The booster seat of claim 26 wherein the side web comprises a first side web disposed on a first side of the booster seat and a second side web disposed on a second side of the booster seat.

28. The booster seat of claim 16 wherein the seat back further comprises a touch fastener strip for securing the seat back to the lower surface of the base.

* * * * *